US010315669B2

(12) United States Patent
Searfoss

(10) Patent No.: US 10,315,669 B2
(45) Date of Patent: Jun. 11, 2019

(54) RAILCAR WITH COVER

(71) Applicant: Timothy K. Searfoss, Alger, MI (US)

(72) Inventor: Timothy K. Searfoss, Alger, MI (US)

( * ) Notice: Subject to any disclaimer, the term of this patent is extended or adjusted under 35 U.S.C. 154(b) by 605 days.

(21) Appl. No.: 14/608,784

(22) Filed: Jan. 29, 2015

(65) Prior Publication Data

US 2016/0185362 A1 Jun. 30, 2016

Related U.S. Application Data

(60) Provisional application No. 62/096,666, filed on Dec. 24, 2014.

(51) Int. Cl.
*B61D 39/00* (2006.01)

(52) U.S. Cl.
CPC ..... *B61D 39/002* (2013.01); *B61D 39/006* (2013.01)

(58) Field of Classification Search
CPC ... B60J 7/068; B60J 7/041; B60J 7/085; B60J 5/14; B60J 7/196; B61D 39/002; B61D 39/006
USPC ..... 105/377.01, 377.02, 377.04, 377.09
See application file for complete search history.

(56) References Cited

U.S. PATENT DOCUMENTS

| | | | | |
|---|---|---|---|---|
| 4,138,154 | A * | 2/1979 | McKeon | B60J 7/068 296/98 |
| 4,864,686 | A * | 9/1989 | Lasier | E05D 15/0621 104/140 |
| 5,040,843 | A * | 8/1991 | Russell | B60J 7/068 160/133 |
| 5,829,819 | A * | 11/1998 | Searfoss | B60J 7/085 242/225 |
| 6,352,035 | B1 * | 3/2002 | Kashiwase | B60F 1/043 104/154 |
| 8,701,565 | B2 | 4/2014 | Creighton et al. | |
| 9,296,285 | B2 * | 3/2016 | Copp | |
| 2003/0123961 | A1 | 7/2003 | Lewis et al. | |
| 2006/0243159 | A1 | 11/2006 | Khattab et al. | |
| 2007/0214997 | A1 | 9/2007 | Zupancich | |
| 2007/0227395 | A1 | 10/2007 | Zaerr | |
| 2010/0037798 | A1 | 2/2010 | Schaefer et al. | |
| 2010/0219148 | A1 | 9/2010 | Forbes et al. | |
| 2010/0258032 | A1 | 10/2010 | Haymond et al. | |
| 2011/0030575 | A1 | 2/2011 | Schaefer et al. | |
| 2011/0084513 | A1 | 4/2011 | Chenowth et al. | |
| 2011/0221233 | A1 | 9/2011 | Damsi | |
| 2011/0265684 | A1 | 11/2011 | Knight et al. | |
| 2016/0194010 | A1 * | 7/2016 | Pettibone | B61D 39/002 105/377.09 |

* cited by examiner

*Primary Examiner* — Mark T Le
(74) *Attorney, Agent, or Firm* — Larson Newman, LLP; Timothy G. Newman

(57) ABSTRACT

A railcar has a pair of sidewalls, a cover, a take up spool, and a motor. The take up spool may store panels of the cover, and the motor moves the cover between a retracted position and an extended position.

17 Claims, 14 Drawing Sheets

RAILCAR WITH COVER

CROSS-REFERENCE TO RELATED APPLICATION(S)

This application claims priority to U.S. Provisional Patent Application No. 62/096,666, entitled "Railcar With Cover," filed on Dec. 24, 2014, which is incorporated herein by reference in its entirety.

FIELD OF THE DISCLOSURE

The present disclosure generally relates to covers for railcars.

BACKGROUND

Railcars are widely known. Such railcars can have covers.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
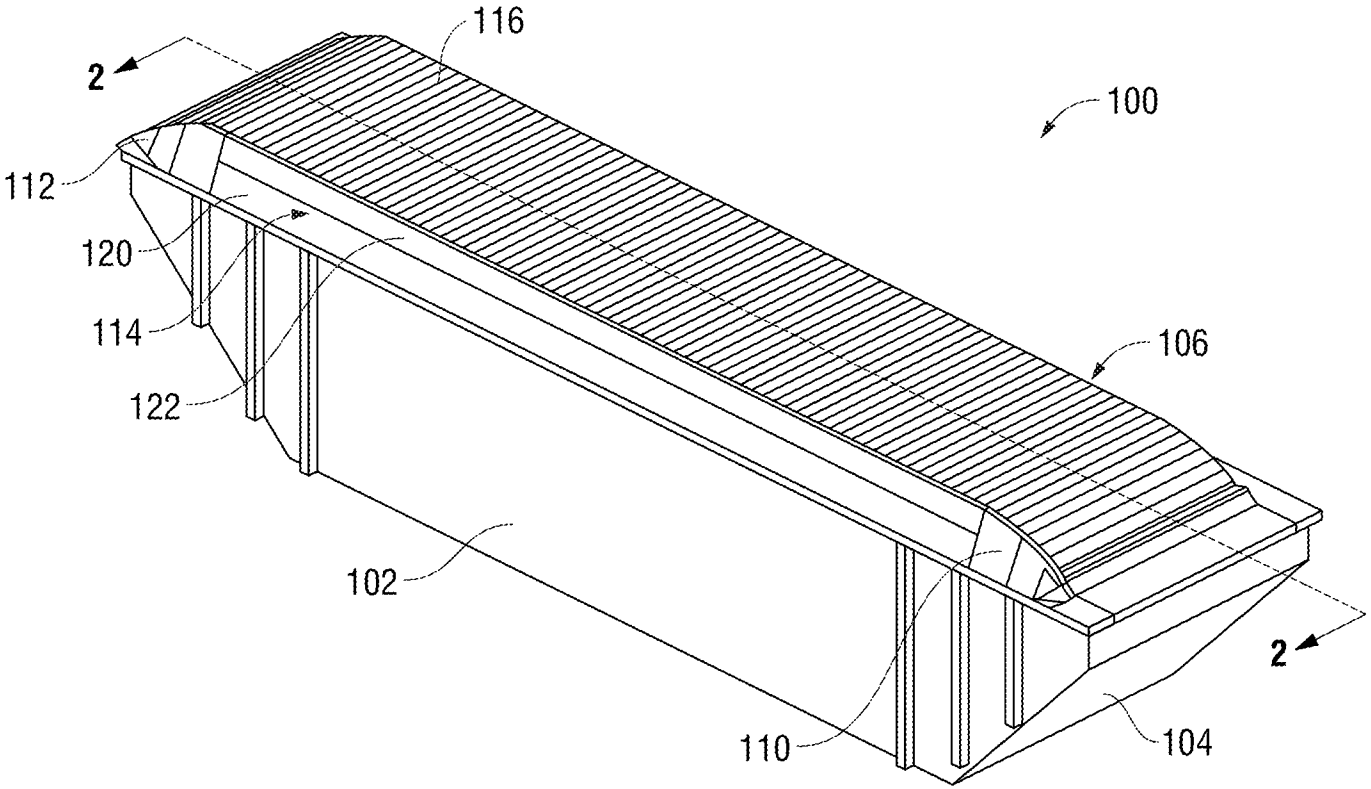
FIG. 1 is a perspective view of a railcar with a cover assembly, according to one embodiment of the present disclosure.
Figure 2:
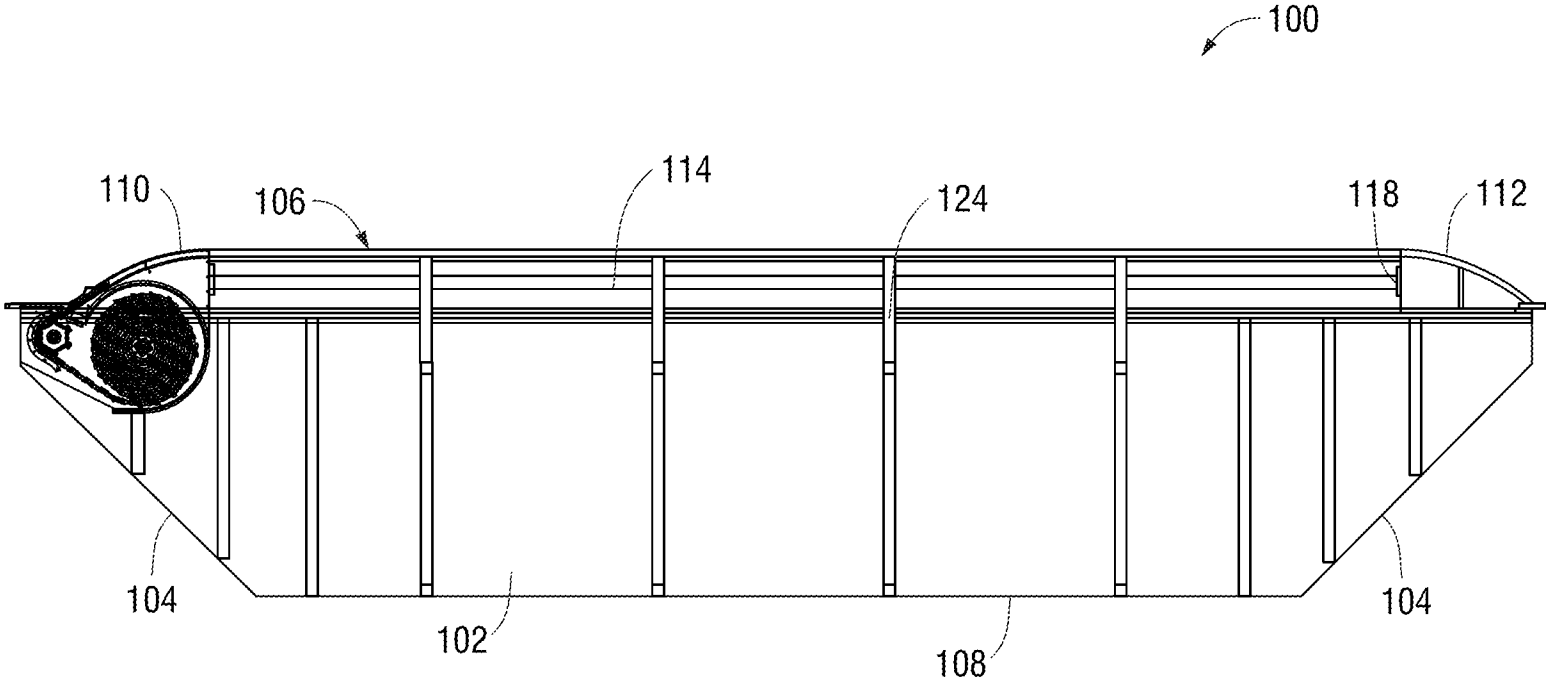
FIG. 2 is a cross-sectional view of the railcar taken along line 2-2 in FIG. 1.

FIGS. 1 and 2 show a container 100 having side walls 102, end walls 104, and a cover assembly that includes retractable cover 106. The side walls 102 extend generally vertically, while the end walls 104 slope at about forty-five degree to the horizontal. In one particular embodiment, the container 100 may be outfitted as a railcar and adapted to transport coal. For this and similar applications, a bottom 108 of the railcar can include hopper doors that open outwardly allow the contents of the railcar to dump out through the bottom.

The cover assembly 106 includes opposed end caps 110 and 112, side rails 114, and a series of panels 116. The end caps 110 and 112 are preferably aluminum castings that interlock with the side rails 114 in any suitable manner, such as by mounting extensions 118. The side rails are preferably formed by a lower extrusion 120 that is fixed, such as by rivets, to an upper extrusion 122. In one embodiment, the lower extrusions 120 may be fastened, such as by bolts or rivets, to both the top of the side walls 102 of the railcar and to braces or cross members in the interior of cars by a descending leg 124 that is best seen in FIG. 2. The upper extrusions 122 have an inwardly facing rectangular channel through which the ends of the panels 116 translate, as described more fully below.

Figure 3:
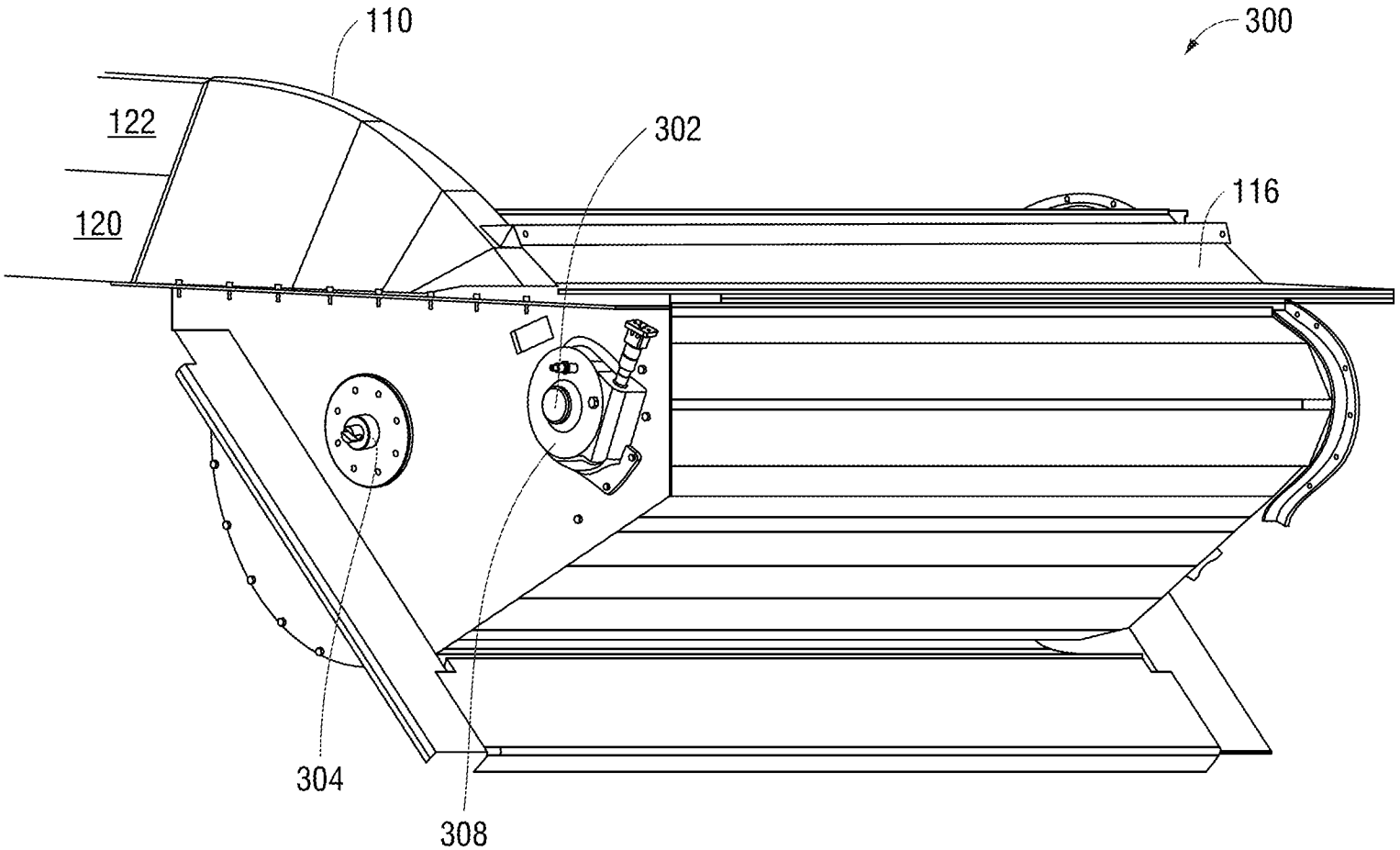
FIG. 3 is a perspective view of a drive and storage unit for the cover assembly.
Figure 4:
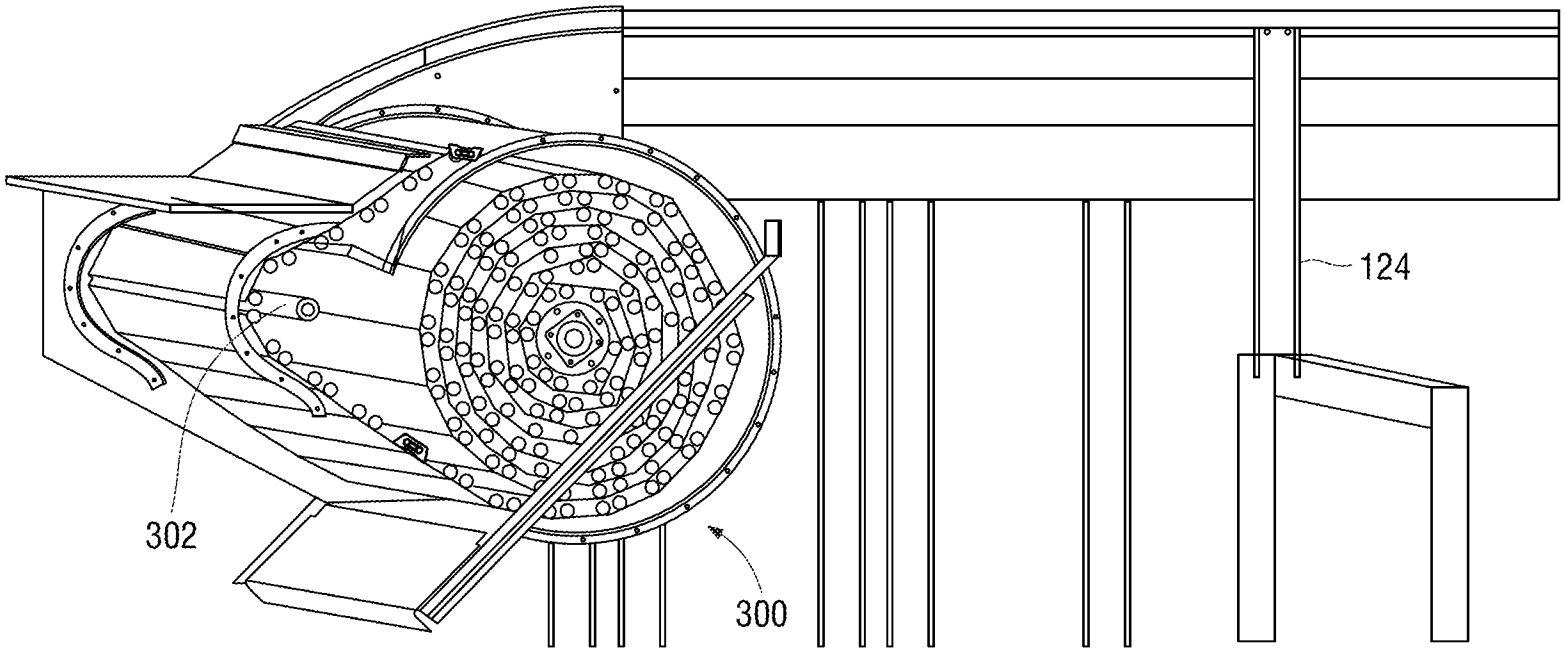
FIG. 4 is a perspective view cut away to show the interior of the drive and storage unit.
Figure 5:
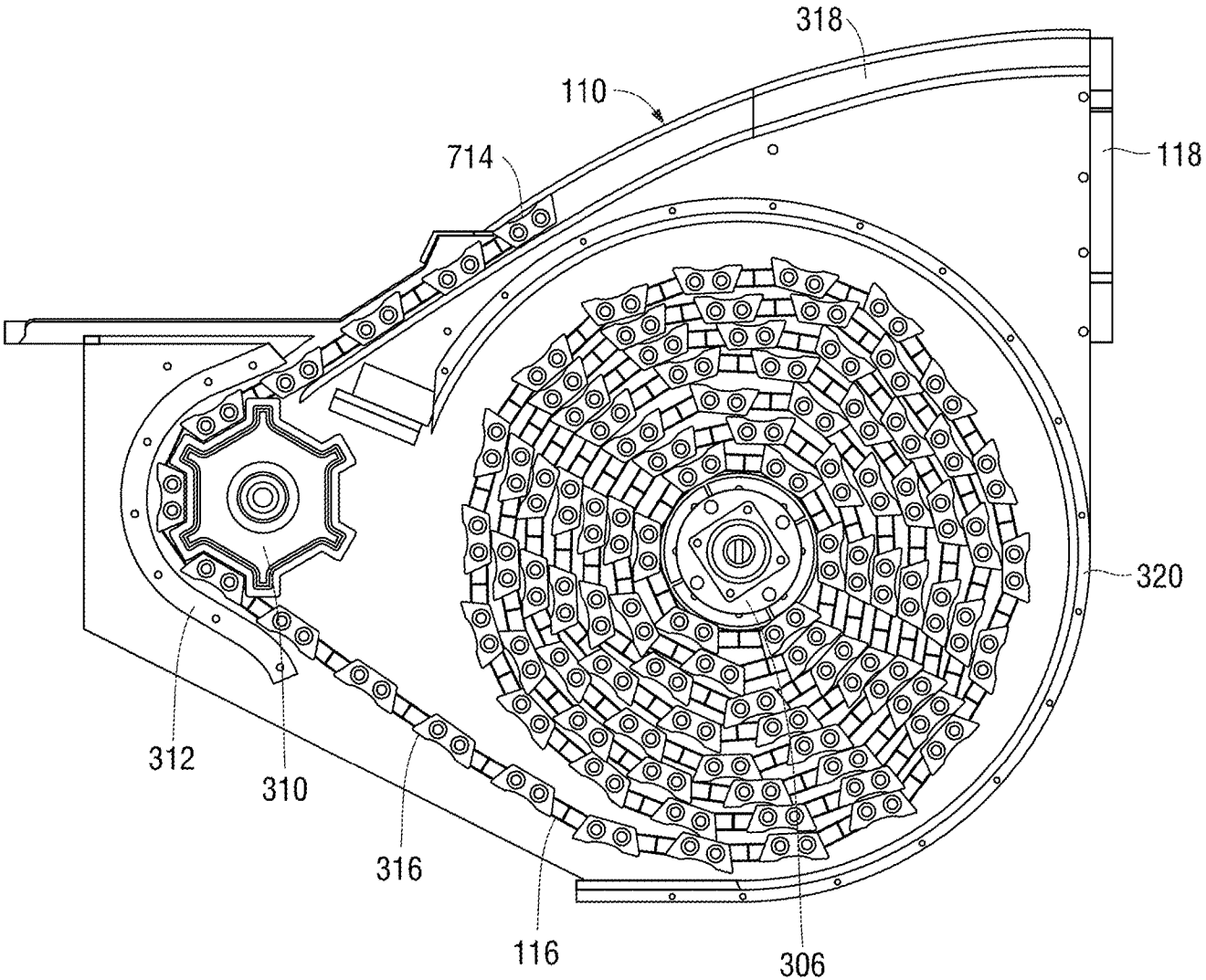
FIG. 5 is a side view of the interior of the drive and storage unit.
Figure 6:
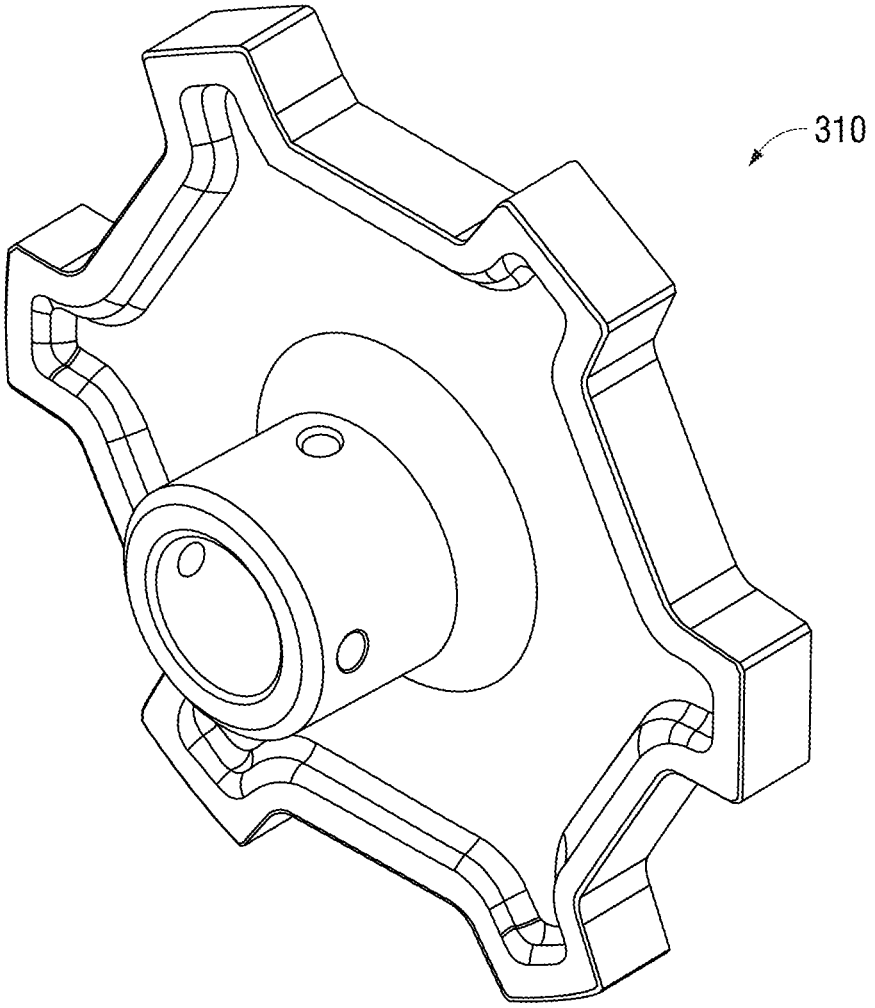
FIG. 6 is a perspective view of a drive sprocket of the cover assembly.

FIGS. 3-5 show a drive and storage unit 300 for powering the cover assembly 106 between extended and retracted positions. The drive and storage unit 300 includes a drive axle 302, a take up axle 304, and a take up spool 306. The drive axle 302 extends transversely across the railcar, and is supported at one end in a roller bearing assembly and is engaged at the other end with a gear motor 308. The drive axle 302 is rotationally fixed to a pair of sprockets 310, one of which is shown in isolation in FIG. 6. In one embodiment, the sprockets 310 are cast aluminum and each has six teeth, the faces of which are slightly convex and form an angle of about 71.8 degrees to one another.

The take up axle 304 is fixed with respect to the railcar, while the spool 306 is free to rotate about the take up axle on bearings. In one embodiment, the spool is an aluminum extrusion eleven inches in diameter. A cast aluminum guide 312 is riveted to the drive and storage unit 300. Slides 316 connect the panels 116 as described below. The guide 312 guides the slides 316 into engagement with the sprockets 310, and holds them in engagement until the slides enter into channels 318 formed in the end cap 110. A shield 320 is disposed mostly around the panels wound on the spool 306 and between the spool and the interior of the railcar.

Figure 7:
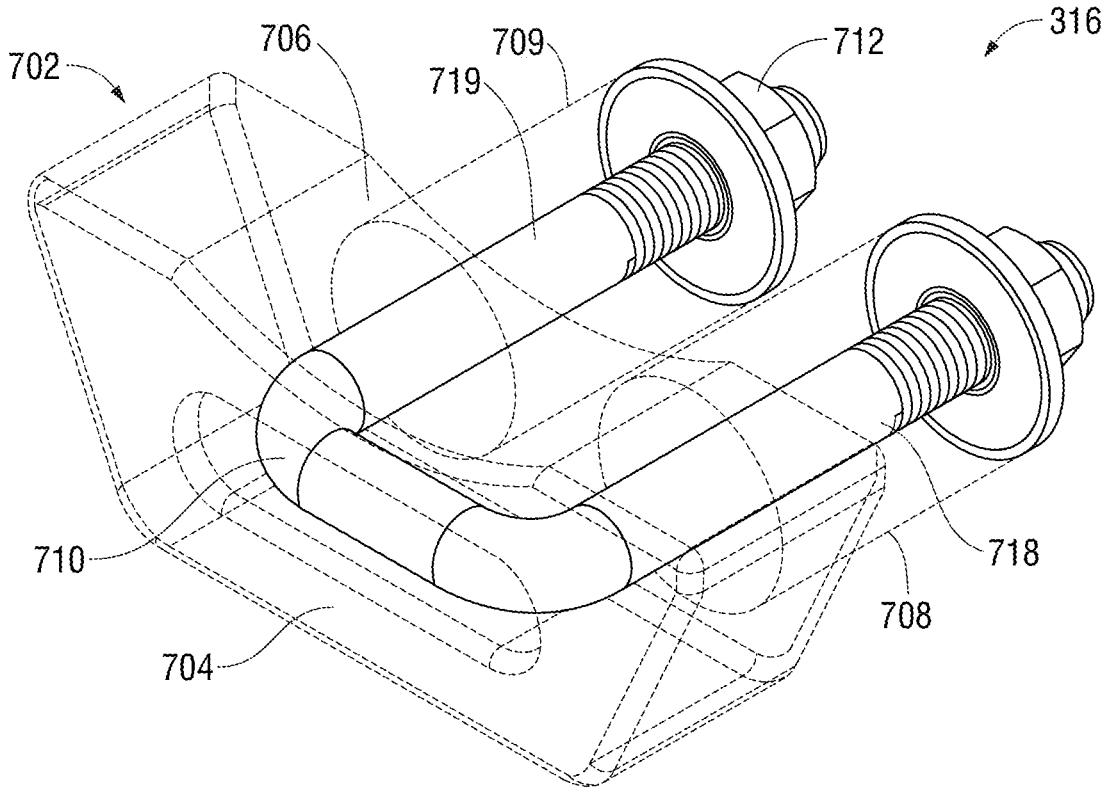
FIG. 7 is a perspective view of a slide of the cover assembly.
Figure 8:
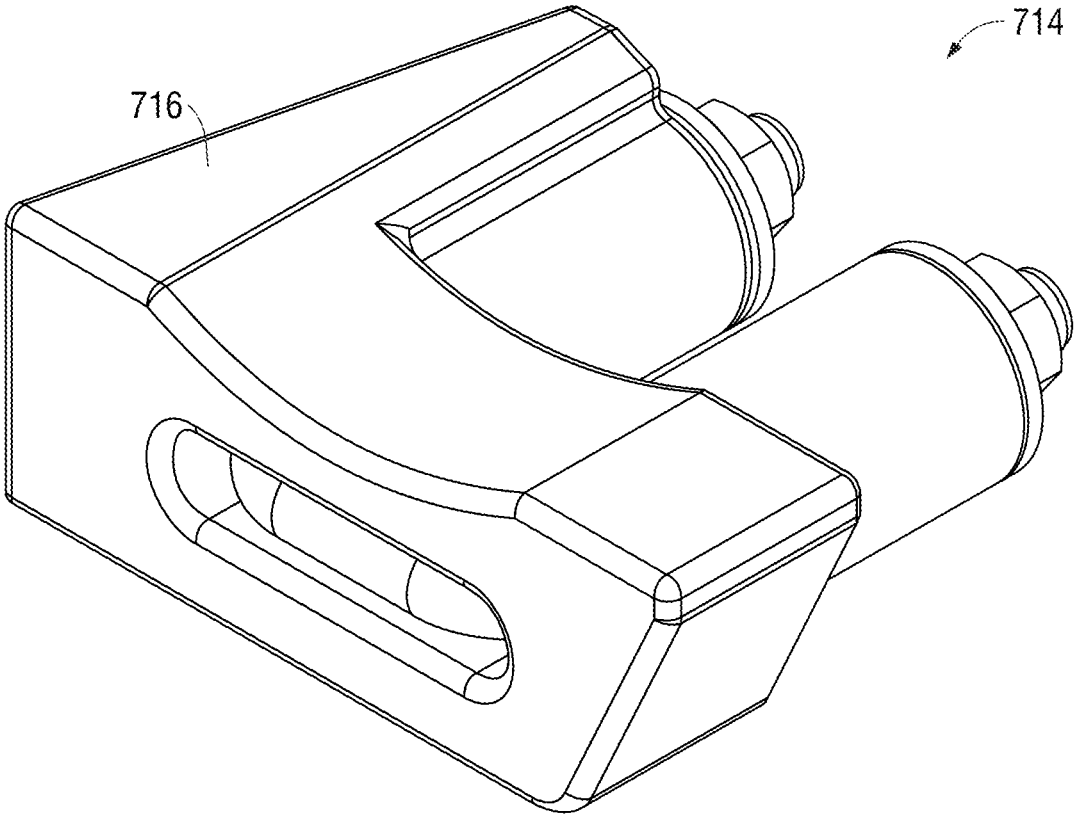
FIG. 8 is a perspective view of a lead slide of the cover assembly.

FIG. 7 shows one of the slides 316 in greater detail. Each slide has a body 702 that is preferably molded out of a polymer such as nylon. The body has a generally trapezoidal main section 704 with a concave portion 706, and a pair of legs 708 and 709 that extend from the main section. A U-bolt 710 is retained through the main section 704, and has legs 718 and 719 that extend through the corresponding legs 708 and 709 of the slide. Washers and nuts 712 retain the U-bolt 710 to the slide 316. In a preferred embodiment, the slides are slightly less that two inches tall and about five inches long, with a center distance between the legs 708 and 709 of about two inches. FIG. 8 shows a lead slide 714 having an edge 716 that acts as a track cleaner to clear light debris from the channel 318.

Figure 9:
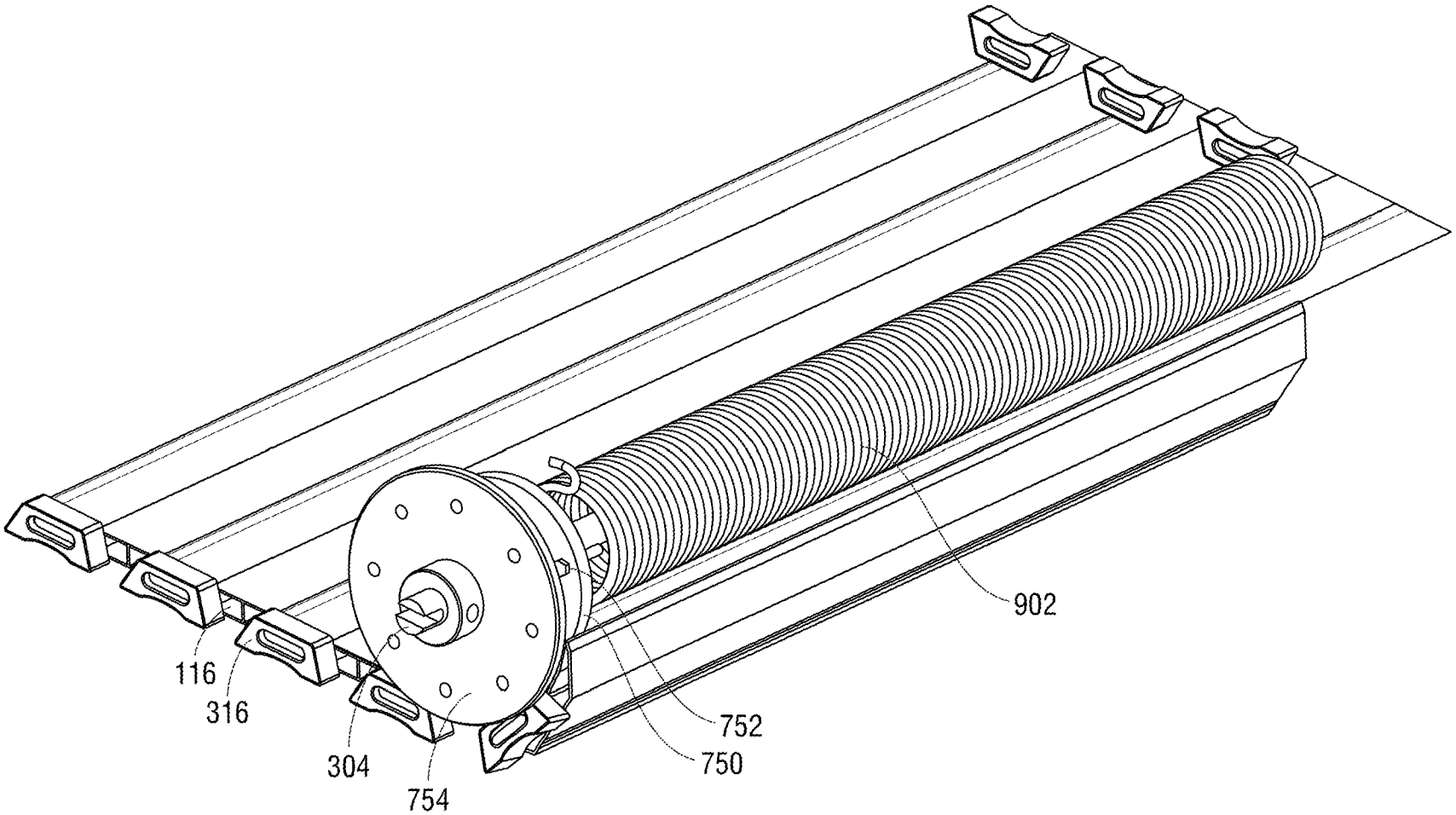
FIG. 9 is a perspective view of a cover storage assembly with a take up spool removed for clarity.
Figure 10:
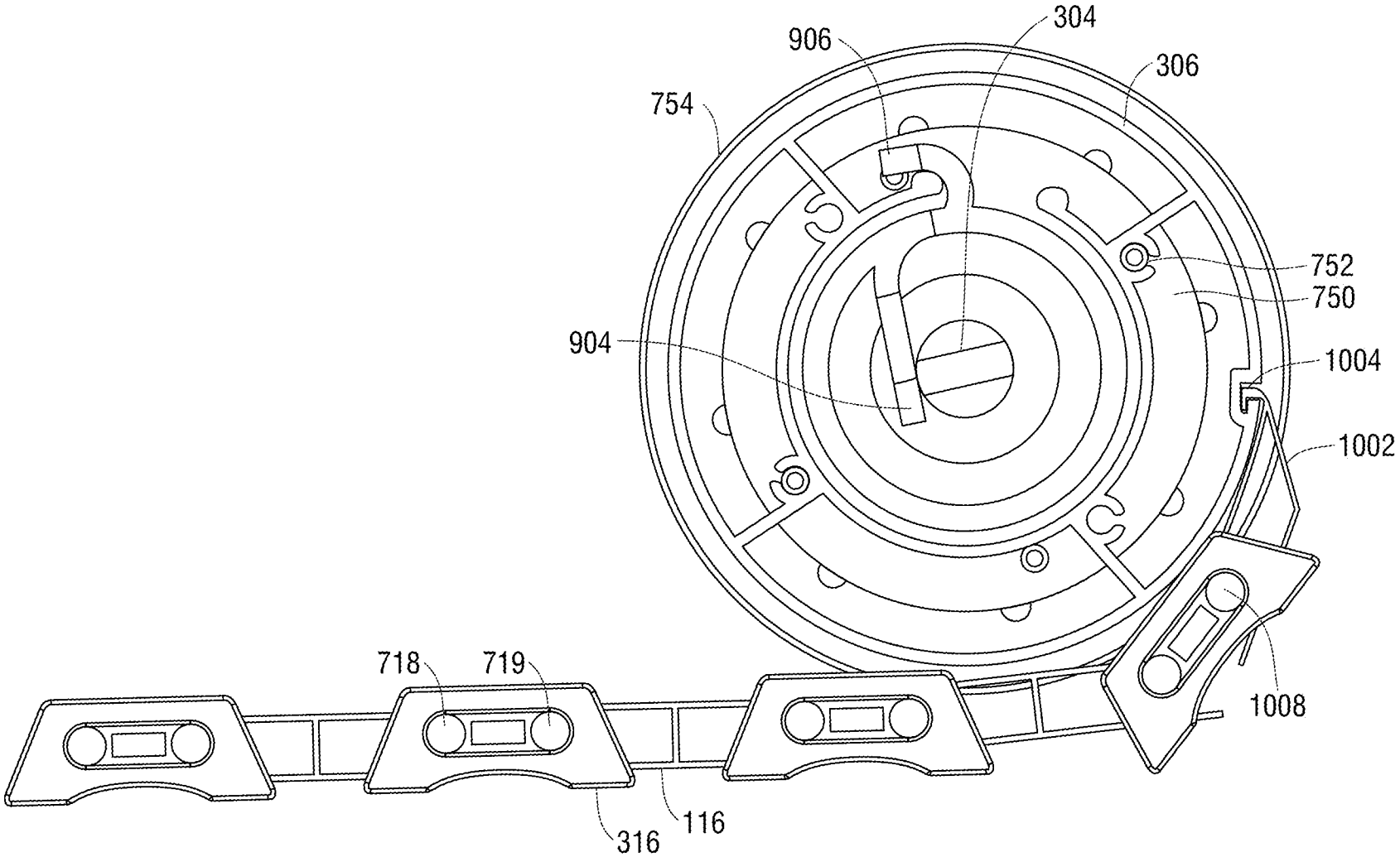
FIG. 10 is a cross-sectional view showing the take up spool engaging a series of slides.
Figure 11:
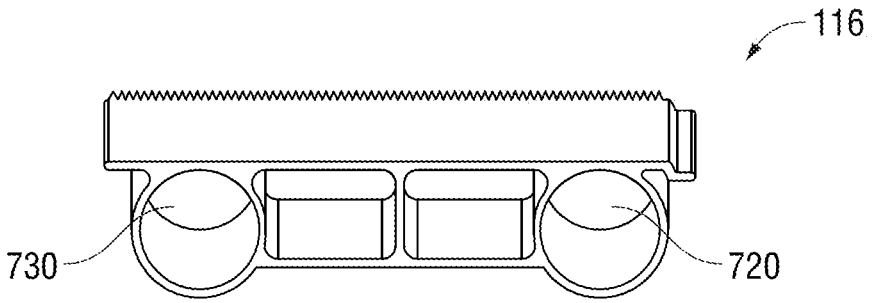
FIG. 11 is a perspective view of part of a main panel of the cover assembly.
Figure 12:
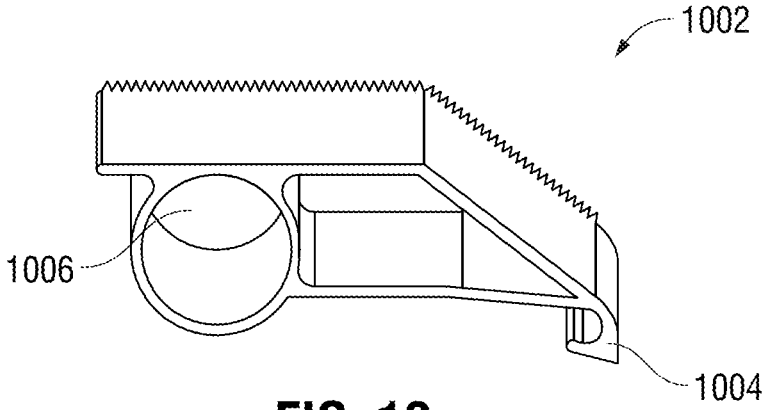
FIG. 12 is a perspective view of part of an anchor panel of the cover assembly.

FIGS. 9 and 10 show a cover storage assembly with the cover in an almost fully extended position. Each slide 316 connects two adjacent panels 116. In particular, the leftmore (as shown) U-bolt leg 718 reinforces one leg of the slide that connects into a first hole 720 in one of the adjacent panels as shown in FIG. 11, and the rightmore leg 719 supports the other leg of the slide that inserts into a similar hole 730 in the other adjacent panel. An anchor or terminal panel 1002, shown in isolation in FIG. 12, has a projection 1004 that is received in a mating groove in the take up spool 306. A single hole 1006 in the anchor panel accepts a U-bolt leg 1008 and its surrounding slide leg.

Figure 13:
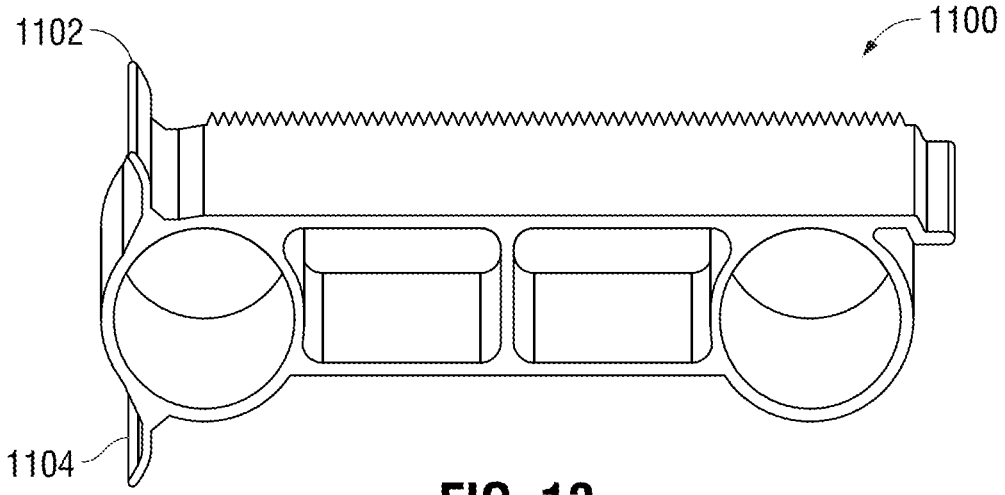
FIG. 13 is a perspective view of part of a lead panel of the cover assembly.

FIG. 13 shows a portion of a lead panel 1100. The lead panel 1100 is similar to the main panels 116, but is provided with flanges 1102 and 1104 to scrape off the top of any load in the railcar that might otherwise extend above the cover.

The take up spool 306 is fixed at each end to an adaptor casting 750, such as by bolts 752. In a preferred embodiment, only the panels make contact with the spool 306. The slides 316 ride in a lateral space between the adaptor 750 and a cast axle carrier 754, and around roller bearings disposed in that space and about the aluminum axle 304.

Figure 14:
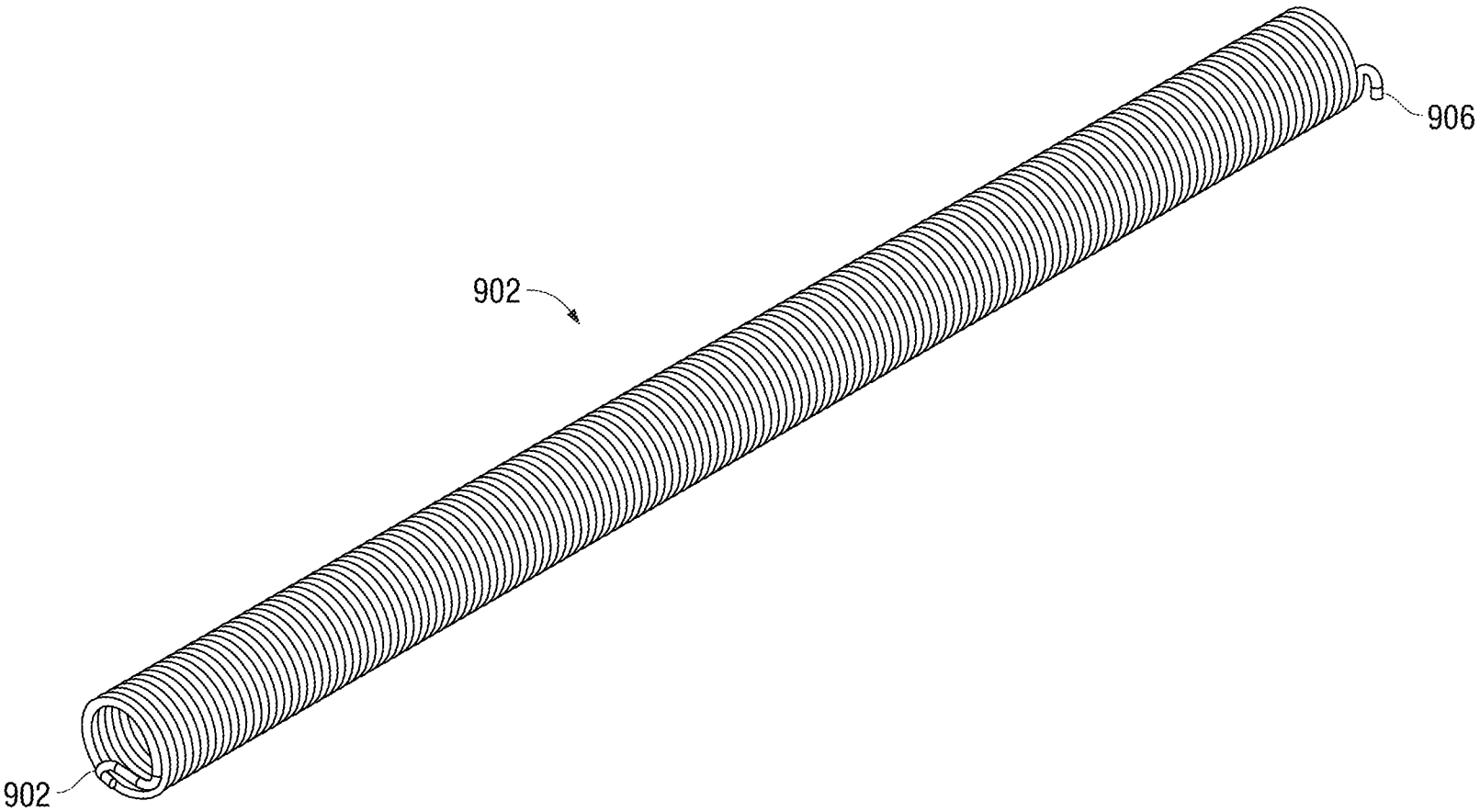
FIG. 14 is a perspective view of a spring of the cover assembly.

The take up spool 306 is normally biased in a counterclockwise direction as shown in FIG. 10 by a coil spring 902. The coil spring is disposed around the axle 304, which is preferably about one and three quarters inches in diameter. A polymer liner, such as one made of Teflon, may be disposed between the outside of the spring 902 and the inside of the spool 306 in order to minimize friction therebetween. One end 904 of the spring 902, best seen in FIG. 14, hooks into the stationary axle 304. An opposite end 906 of the spring hooks into the spool 306 so that the panels 116 are normally wound onto the spool to put the cover in a retracted position.

Figure 15:
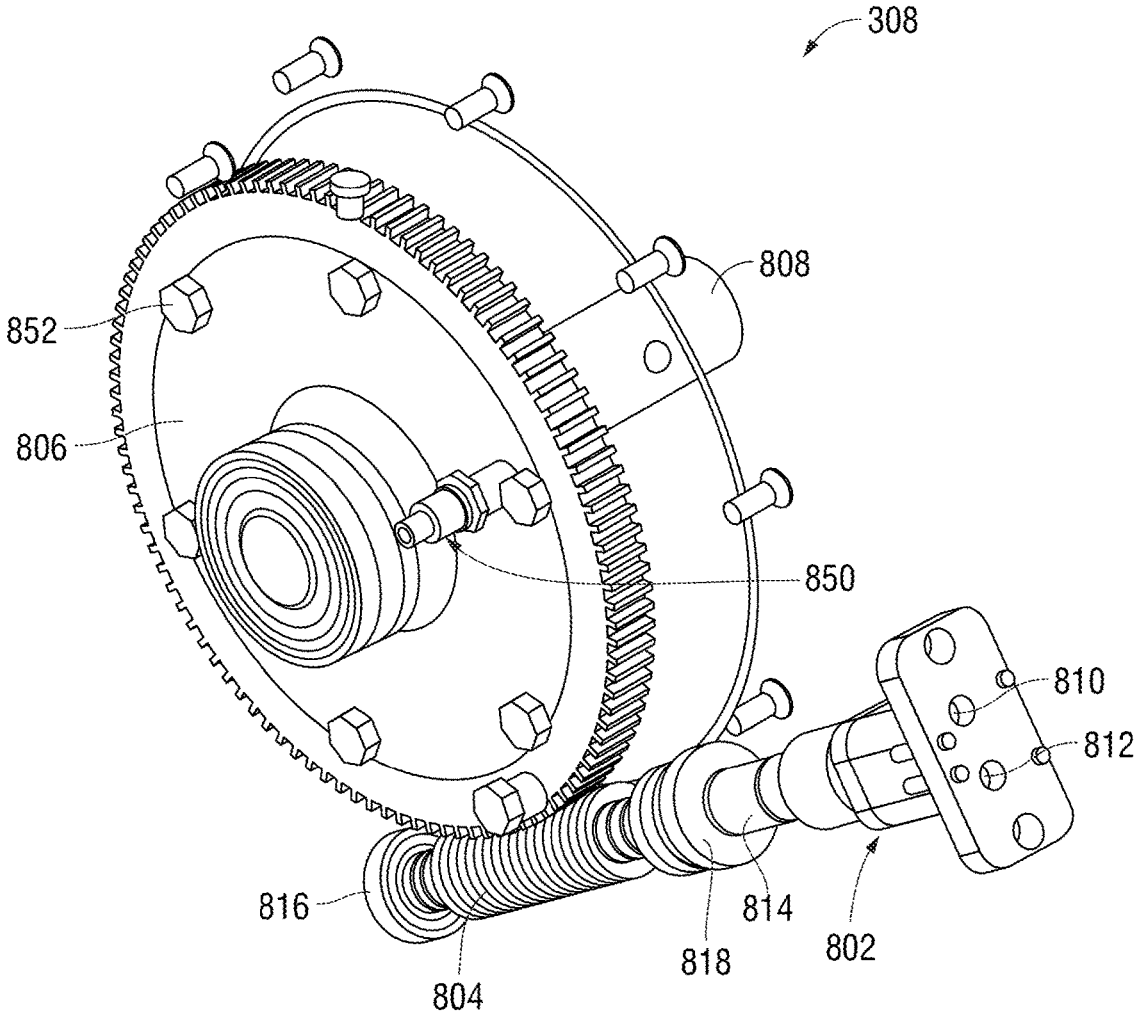
FIG. 15 is a perspective view of a transmission housing including an air motor and gears.

FIG. 15 shows the gear motor 308 including an air motor 802, a worm 804, an output gear 806 and an output shaft 808. The air motor 802 is preferably similar to those found in impact wrenches, and has an air inlet port 810 and an air outlet port 812. The ports 810 and 812 may be connected to a pneumatic system of the railcar (not shown) that normally includes storage tanks charged to about one hundred fifty pounds per square inch. While the air motor 802 can usually operate at a range of air pressures, a regulator may be added to regulate the pressure supplied to the air motor. The air motor drives a socket 814 with a torque in the range of about two hundred foot pounds. The socket 814 in turn drives the worm 804, which is mounted in roller bearings 816 and 818, at a ratio of about 120 to 1 so that about twenty-four thousand pounds of gross force is available to drive the output gear at the efficiency of the worm. An oil level preferably is maintained to cover the worm 804 in operation.

A proximity sensor 850 is provided through one wall of the gear motor 308. The proximity sensor 850 detects the position of the output gear 806, such as by incrementing or decrementing a counter according to the passage of bolt heads 852. In one embodiment the proximity sensor 850 operates magnetically, but it should be understood that the proximity sensor may operate in any other suitable manner such as optically.

Figure 16:
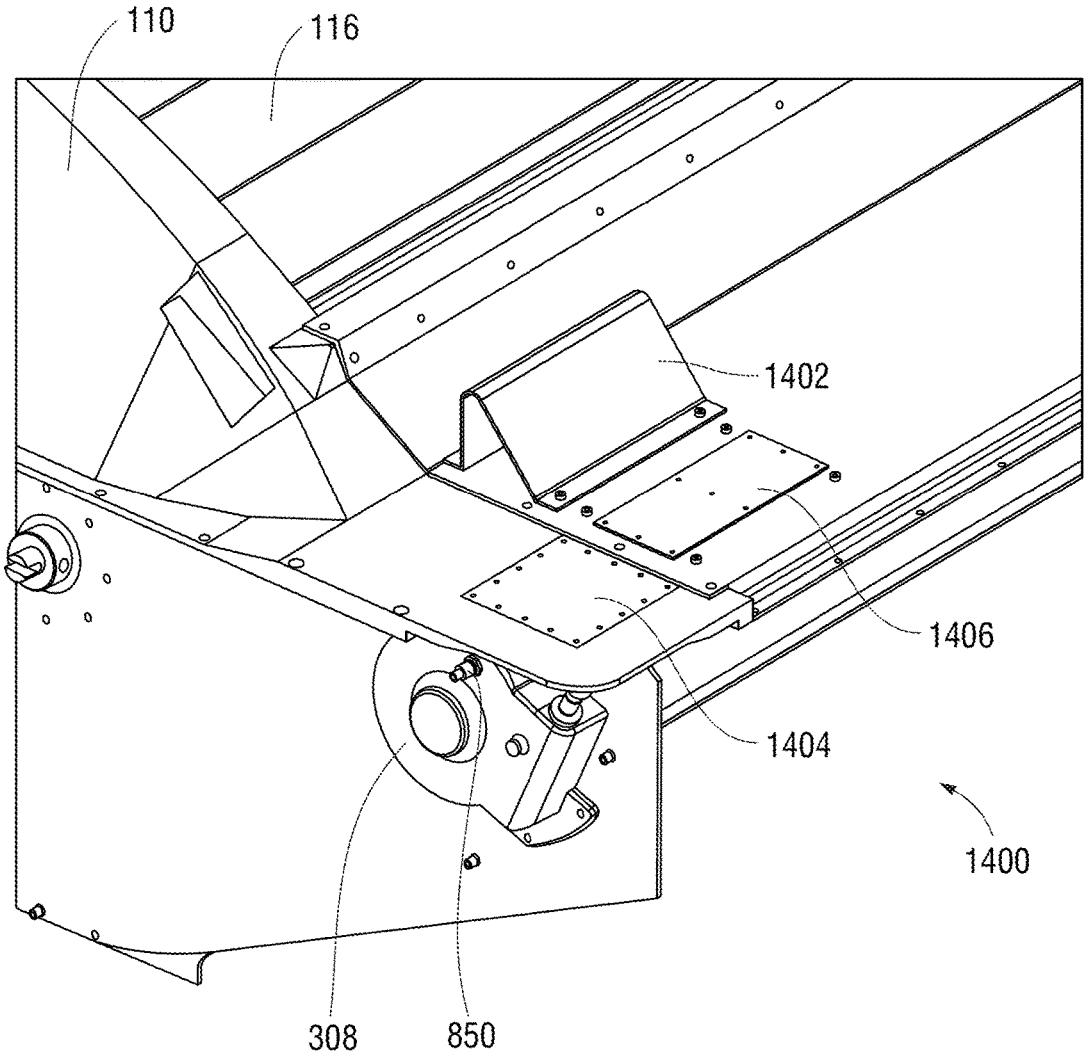
FIG. 16 is a perspective view of a further embodiment of the drive and storage unit.

FIG. 16 shows an alternative embodiment 1400 of the drive and storage unit. The unit 1400 includes a mount 1402 for one or more solar panels, an access panel 1404, and an access panel 1406. The access panel 1404 is removable to allow access to components such as the gear motor 308 or the proximity sensor 850. The access panel 1406 is also removable to allow access to a tool box that may contain batteries rechargeable by the solar panels, a controller (not shown) powered primarily or secondarily by those batteries and connected to the proximity sensor 850 and to the motor 308, and air valves connected to the air motor.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims.

What is claimed is:

1. A railcar comprising:
- a pair of opposed side walls;
- a cover including a plurality of panels extending between the side walls;
- a take up spool where the panels may be stored;
- a motor drivingly engaged with the panels to move the cover between a retracted position and an extended position;
- a side rail mounted to each side wall, each side rail accepting an end of the panels; and
- a plurality of slides interconnecting the panels, wherein each pair of opposed slides is spaced the same distance apart, and wherein at least one of the slides includes legs extending from the slide and attached to adjacent panels.

2. The railcar of claim 1 wherein each slide is disposed in one of the side rails.

3. The railcar of claim 1 wherein the motor is drivingly engaged with a drive axle.

4. The railcar of claim 3 wherein the motor is drivingly engaged with a sprocket on the drive axle.

5. The railcar of claim 1 wherein the motor includes an air motor and gearing.

6. The railcar of claim 1 wherein the spool is biased toward the retracted position.

7. A railcar comprising:
- a pair of opposed side walls;
- a cover including a plurality of panels extending between the side walls;
- a take up spool upon which the panels may be wound;
- a motor drivingly engaged with the panels to move the cover between a retracted position and an extended position; and
- a plurality of slides interconnecting the panels, wherein adjacent panels are not parallel when the cover is in the retracted position, and wherein at least one of the slides includes legs extending from the slide and attached to the adjacent panels.

8. The railcar of claim 7 further comprising a side rail mounted to each side wall, each slide being disposed in one of the side rails.

9. The railcar of claim 7 wherein the motor is drivingly engaged with a drive axle.

10. The railcar of claim 9 wherein the motor is drivingly engaged with a sprocket on the drive axle.

11. The railcar of claim 7 wherein the motor includes an air motor and gearing.

12. A cover for a railcar having a pair of opposed side walls, the cover comprising:
- a plurality of panels extending between the side walls;
- a take up spool upon which the panels may be wound;
- a motor drivingly engaged with the panels to move the cover from a retracted position to an extended position; and a plurality of slides interconnecting the panels, wherein each pair of opposed slides is spaced the same distance apart, and wherein at least one of the slides includes legs extending from the slide and attached to adjacent panels.

13. The cover of claim 12 wherein each slide is disposed in a side rail mounted to a respective side wall.

14. The cover of claim 12 wherein the motor is drivingly engaged with a sprocket on a drive axle.

15. The cover of claim 12 wherein the motor includes an air motor and gearing.

16. The railcar of claim 7 wherein the spool is based toward a retracted position.

17. The cover of claim 12 wherein the spool is based toward a retracted position.

* * * * *